US008677539B2

(12) United States Patent
Morlacchi et al.

(10) Patent No.: US 8,677,539 B2
(45) Date of Patent: Mar. 25, 2014

(54) WATERPROOF FOOTWEAR AND PROCESS FOR ITS MANUFACTURE

(75) Inventors: Matteo Morlacchi, Legnano (IT); Maurizio Ostani, Montebelluna (IT)

(73) Assignee: OutDry Technologies Corporation, Portland, OR (US)

( * ) Notice: Subject to any disclaimer, the term of this patent is extended or adjusted under 35 U.S.C. 154(b) by 707 days.

(21) Appl. No.: 11/995,493

(22) PCT Filed: Jul. 12, 2006

(86) PCT No.: PCT/IT2006/000531

§ 371 (c)(1), (2), (4) Date: Feb. 20, 2008

(87) PCT Pub. No.: WO2007/007369

PCT Pub. Date: Jan. 18, 2007

(65) Prior Publication Data

US 2008/0216354 A1 Sep. 11, 2008

(30) Foreign Application Priority Data

Jul. 14, 2005 (IT) ..... MI2005A1344

(51) Int. Cl.

| | |
|---|---|
| ***A43B 13/04*** | (2006.01) |
| ***A43D 31/00*** | (2006.01) |
| ***A43B 23/02*** | (2006.01) |
| ***A43B 13/28*** | (2006.01) |
| ***A43C 13/08*** | (2006.01) |
| ***A43B 23/00*** | (2006.01) |
| ***A43B 23/07*** | (2006.01) |

(52) U.S. Cl.
USPC ..... 12/146 BR; 12/146 R; 12/146; 12/146 S; 36/12; 36/14; 36/19 R; 36/46.5; 36/55; 36/57

(58) Field of Classification Search
USPC ..... 36/98, 3 R, 3 A, 14, 18, 19 R, 19 A, 19.5, 36/21, 46.5, 55, 57, 12; 12/145, 146 BR, 12/142 RS, 146 C, 146 I
See application file for complete search history.

(56) References Cited

U.S. PATENT DOCUMENTS

| | | | | | |
|---|---|---|---|---|---|
| 2,638,633 | A | * | 5/1953 | Root | 264/493 |
| 4,692,369 | A | | 9/1987 | Nomi | |
| 4,819,345 | A | * | 4/1989 | Mulcahy et al. | 36/17 R |
| RE34,890 | E | * | 4/1995 | Sacre | 36/55 |
| 5,433,021 | A | * | 7/1995 | Mahler | 36/12 |
| 5,664,343 | A | * | 9/1997 | Byrne | 36/55 |

(Continued)

FOREIGN PATENT DOCUMENTS

| | | | |
|---|---|---|---|
| DE | 10031827 | * | 1/2002 |
| DE | 10031827 C1 | | 1/2002 |

(Continued)

*Primary Examiner* — Clinton T Ostrup
*Assistant Examiner* — Cameron Carter
(74) *Attorney, Agent, or Firm* — Schwabe, Williamson & Wyatt, P.C.

(57) ABSTRACT

Footwear, and a process for manufacturing the same, the footwear having at least one lower portion of an upper joined by one or more seams to an upper portion that is lined internally with at least one waterproofing membrane, whose lower edge is fixed to the inner surface of the lower portion of the upper by a layer of adhesive arranged at least under the seams.

23 Claims, 4 Drawing Sheets

(56) References Cited

U.S. PATENT DOCUMENTS

| | | | | |
|---|---|---|---|---|
| 5,732,480 | A * | 3/1998 | Notzold | 36/14 |
| 5,909,719 | A * | 6/1999 | Throneburg et al. | 12/142 R |
| 5,918,382 | A * | 7/1999 | Haderlein et al. | 36/14 |
| 6,065,227 | A | 5/2000 | Chen | |
| 6,115,940 | A | 9/2000 | Chen | |
| 6,474,002 | B2 * | 11/2002 | Chen | 36/55 |
| 2001/0049886 | A1 | 12/2001 | Chen | |
| 2002/0078593 | A1 * | 6/2002 | Pavelescu et al. | 36/12 |
| 2004/0159012 | A1 * | 8/2004 | Keidel et al. | 36/12 |

FOREIGN PATENT DOCUMENTS

| | | | |
|---|---|---|---|
| FR | 2833142 | A | 6/2003 |
| JP | 08-024002 | A | 1/1996 |
| JP | 2000-175704 | A | 6/2000 |
| WO | 98/29239 | | 7/1998 |

* cited by examiner

WATERPROOF FOOTWEAR AND PROCESS FOR ITS MANUFACTURE

BACKGROUND OF THE INVENTION

The present invention relates to a waterproof footwear, and in particular a footwear which can be provided with a semi-permeable or breathable, i.e. impermeable to water and permeable to water vapor, upper portion. The present invention also relates to a process for manufacturing said footwear.

U.S. Pat. No. 6,065,227 discloses footwear comprising a lower portion of an upper, which is made of a molded waterproof material and is joined by means of two seams to a leather upper portion which has a substantially tubular shape and is lined internally with a waterproof membrane. The seams pierce the waterproofing membrane, so that a waterproof tape must be glued onto the seams for preventing the penetration of water into the footwear. However, the application of the waterproof tape inside the finished footwear is relatively difficult, especially if the footwear is a boot, so that the lower portion of the upper is preferably provided with a wide lower opening for easily reaching the area to be waterproofed. Therefore, it is impossible or at least unadvisable to manufacture the lower portion of the upper in a single piece with the sole of the footwear.

For overcoming this disadvantage, U.S. Pat. No. 6,115,940 discloses a lower portion of the upper which can be carried out in a single piece of a material molded with a sole. As a matter of fact, the upper edge of the lower portion of the upper is provided with an inner lip which can be easily glued onto this edge for sealing the seams. However, this solution requires a particular mould for obtaining said lip in a single piece with the lower portion of the upper with consequently higher manufacturing costs. Furthermore, the presence of the lip hampers the seaming of the lower portion of the upper to its upper portion.

SUMMARY OF THE INVENTION

It is therefore an object of the present invention to provide a waterproof footwear which is free from the disadvantages indicated above, i.e. which can be manufactured in a simple and economical way.

Thanks to the particular arrangement of the waterproofing membrane, the seam between the upper and lower portions of the upper is sealed internally in a simple and effective manner. This arrangement simplifies also the process for its manufacture, especially if the lower portion of the upper is made of a single piece of material molded with the sole of the footwear and/or if a particular expandable last is employed.

The waterproofing membrane is preferably permeable to water vapor and is elastic with a coefficient of elongation higher than 50%, while the adhesive used for gluing it to the upper is preferably waterproof and thermoactivable, so as to improve both the waterproofing and the comfort of the footwear.

BRIEF DESCRIPTION OF THE DRAWINGS

Further advantages and features of the footwear and of the process according to the present invention will become clear to those skilled in the art from the following detailed and non-limiting description of some embodiment thereof with reference to the attached drawings, wherein.

DETAILED DESCRIPTION OF THE INVENTION

Figure 1:
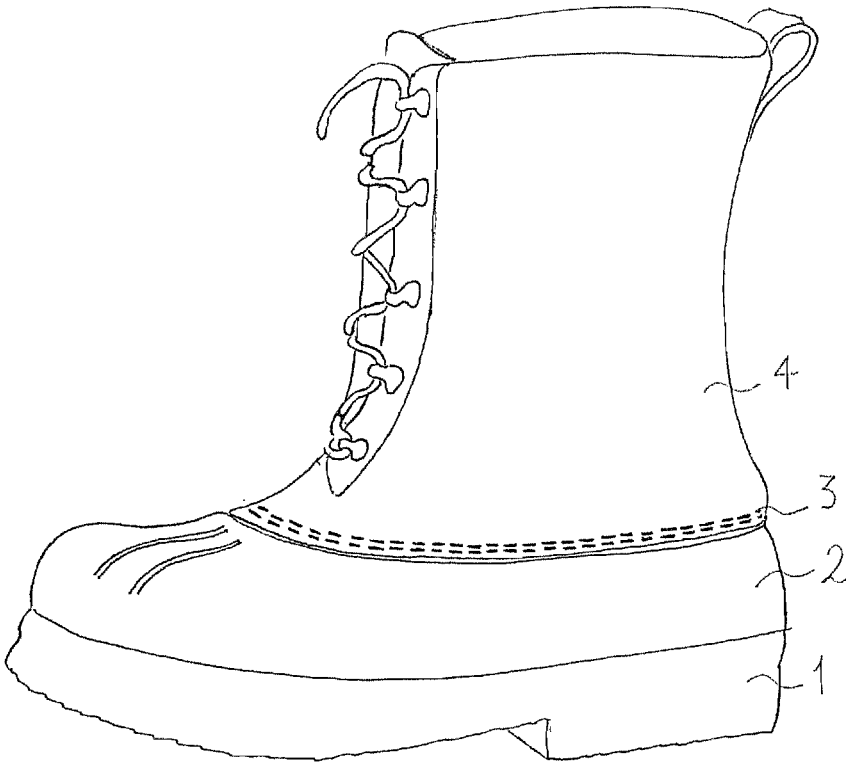
FIG. 1 shows a perspective view of the footwear.

Referring to FIG. 1, it is seen that the footwear according to the present invention comprises in a known way a lower casing which is suitable for containing a foot and includes at least one sole 1 joined to a lower portion 2 of an upper. In the present embodiment, sole 1 and the lower portion 2 of the upper are preferably formed by a single piece of a waterproof molded material, in particular rubber or polyurethane, but in other embodiments they can be formed by two or more pieces molded separately, which are then joined to each other. The lower portion 2 of the upper is joined by means of one or more seams 3 to an upper portion 4 of the upper, which has a substantially tubular shape and is made of a material permeable to water, in particular leather or fabric.

Figure 2:
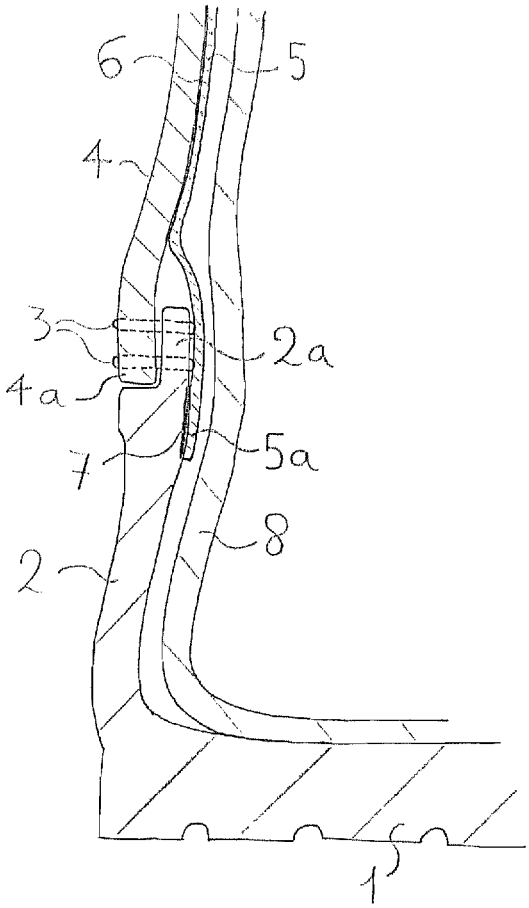
FIG. 2 shows a partial, enlarged and sectioned view of the footwear of FIG. 1 according to a first embodiment of the invention.

With reference to FIG. 2, it is seen that the inner surface of the upper portion 4 of the upper is lined with at least one waterproofing membrane 5, preferably semipermeable or breathable, i.e. impermeable to water and permeable to water vapor, in particular with a permeability to water vapor greater than 400 $g/m^2$*24 h. The waterproofing membrane 5 is preferably elastic with a coefficient of elongation higher than 50% and is made of a polymeric material, for example PTFE, polyurethane or polyester. The waterproofing membrane 5 can be also coupled with an inner protective fabric. In the present embodiment of the invention, the waterproofing membrane 5 is fixed to the upper portion 4 of the upper by means of a discontinuous or continuous layer of adhesive 6, in particular polyurethane glue, so that the upper portion 4 of the upper remains breathable if the waterproofing membrane 5 is semipermeable. The lower edge 5*a* of the waterproofing membrane 5 preferably protrudes under the lower edge 4*a* of the upper portion 4 of the upper.

According to the invention, the lower edge 5*a* of the waterproofing membrane 5 is not joined to the upper portion 4 of the upper but is instead fixed to the inner surface of the lower portion 2 of the upper by means of a continuous layer of adhesive 7 arranged at least under seams 3. Adhesive 7 is preferably waterproof and thermoactivable. The upper edge 2*a* of the lower portion 2 of the upper is preferably comprised between the waterproofing membrane 5 and the lower edge 4*a* of the upper portion 4 of the upper. A sock 8 acting as an inner lining can be fixed into the footwear.

Figure 3:
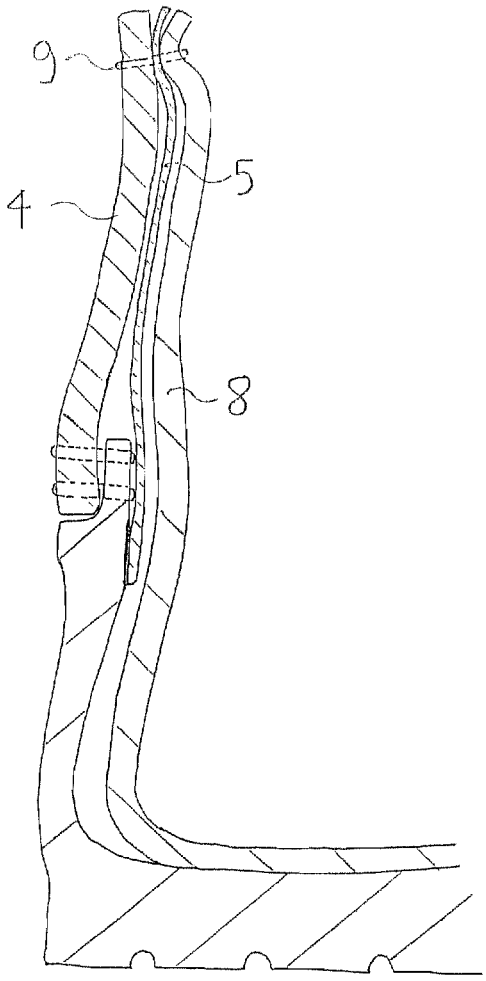
FIG. 3 shows a partial, enlarged and sectioned view of the footwear of FIG. 1 according to a second embodiment of the invention.

Referring to FIG. 3, it is seen that in a second embodiment of the invention, the waterproofing membrane 5 is not glued to the upper portion 4 of the upper, but is instead joined thereto by means of at least one seam 9 made at the top of the upper portion 4 of the upper. Also sock 8 is joined to the upper by means of seam 9.

For manufacturing said footwear, a waterproofing membrane 5 is shaped and two opposite edges thereof are mutually glued, so as to form a tubular waterproofing sheath which can be glued and/or seamed into the upper portion 4 of the upper. The lower edge 5*a* of the waterproofing membrane 5 can be folded up and temporarily fixed into the same membrane, for example by means of pieces of adhesive tape, so as to not hamper the seaming step. Adhesive 7 is applied inside the lower portion 2 of the upper, after which the latter is joined to the upper portion 4 of the upper by means of seams 3.

Figure 4:
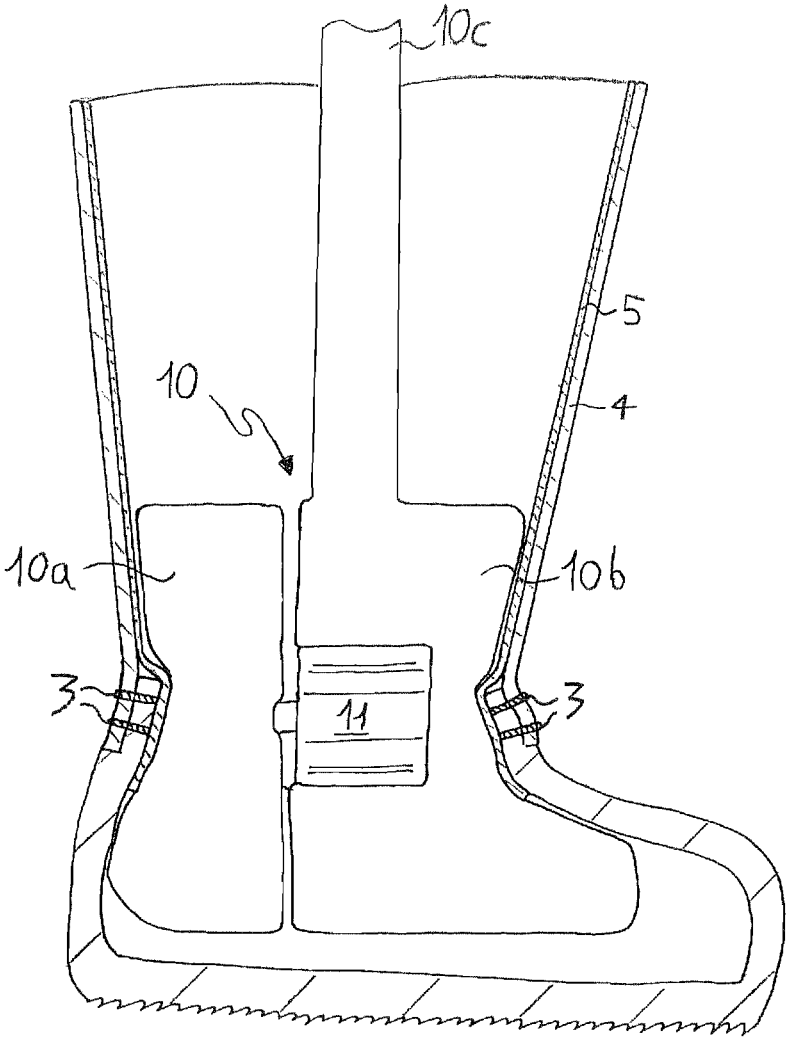
FIG. 4 shows a longitudinally sectioned view of the footwear of FIG. 1 during the manufacturing process.

Referring to FIG. 4, it is seen that the lower edge 5*a* of the waterproofing membrane 5 is extended downwards and arranged against the layer of adhesive 7, preferably with the aid of a last 10 inserted into the footwear. The latter can be then heated, for example in a oven, for activating adhesive 7. Alternatively or additionally, last 10 can be heated to at least 50° C. before it is inserted into the footwear. When adhesive 7 is activated, the footwear is laterally pressed in a uniform and continuous way for pressing the lower portion 2 of the upper against the waterproofing membrane 5. Before said pressing is carried out, last 10 can be expanded in the footwear and for this purpose it is provided with at least two shaped members 10*a*, 10*b*, rigid or semirigid, which can be mutually moved away by an extensible device 11, for example a pneumatic piston, wherein the first shaped member 10*a* corresponds to a portion of the foot which includes the heel, while the second shaped member 10*b* corresponds to a portion of the foot which includes the tip. A rod 10*c* which protrudes out of the footwear is joined to the first shaped member 10*a* or to the second shaped member 10*b*. The outer surface of last 10 is preferably concave in correspondence with seams 3. After the pressing, last 10 is retracted and extracted from the footwear when the latter has cooled.

Further modifications and/or additions may be made by those skilled in the art to the hereinabove described and illustrated embodiments, while remaining within the scope of the following claims.

The invention claimed is:

1. A process for manufacturing footwear, comprising the following in sequential order:

fixing a continuous waterproofing membrane formed of a single piece inside at least one upper portion of an upper; then folding up a lower edge of the waterproofing membrane; then temporarily fixing the lower edge of the waterproofing membrane to an inside surface of the waterproofing membrane; then joining at least one lower portion of the upper to the at least one upper portion by one or more seams; then unfixing the lower edge of the waterproofing membrane from the inside surface of the waterproofing membrane; and then fixing the lower edge of the waterproofing membrane to the at least one lower portion of the upper by a layer of adhesive applied inside the lower portion at least under the one or more seams.

2. The process according to claim 1, wherein the layer of adhesive is applied inside the at least one lower portion of the upper before the at least one lower portion and the at least one upper portion of the upper are joined to each other.

3. The process according to claim 1, wherein the waterproofing membrane is permeable to water vapor.

4. The process according to claim 1, wherein said adhesive is waterproof.

5. The process according to claim 1, wherein said adhesive is thermoactivable.

6. The process according to claim 1, wherein before the waterproofing membrane is fixed inside the at least one upper portion of the upper, the waterproofing membrane is shaped and two opposite edges of the waterproofing membrane are mutually glued, forming a tubular waterproofing sheath.

7. The process according to claim 1, wherein the waterproofing membrane is glued to the at least one upper portion of the upper.

8. The process according to claim 1, wherein the waterproofing membrane is joined to the at least one upper portion of the upper by at least one seam made above the seams joining the at least one lower portion and the at least one upper portion of the upper.

9. The process according to claim 1, wherein the at least one lower portion of the upper is made of a waterproof material.

10. The process according to claim 9, wherein the waterproof material is rubber or polyurethane.

11. The process according to claim 1 wherein the at least one lower portion of the upper is made of a single piece of a material molded with the sole.

12. The process according to claim 1, wherein the at least one upper portion of the upper has a substantially tubular shape and is made of a material permeable to water.

13. The process according to claim 12, wherein the material is a leather or fabric.

14. The process according to claim 1, wherein an upper edge of the lower portion of the upper is assembled between the waterproofing membrane and a lower edge of the upper portion of the upper.

15. The process according to claim 1, wherein a last is inserted into the footwear after the at least one lower portion and the at least one upper portion of the upper are joined to each other.

16. The process according to claim 15, wherein the footwear is heated after the last has been inserted therein.

17. The process according to claim 15, wherein the footwear is pressed laterally after the last has been inserted therein.

18. The process according to claim 15, wherein the last is heated to at least 50° C. before it is inserted into the footwear.

19. The process according to claim 15, wherein the last is expanded in the footwear.

20. The process according to claim 15, characterized in that the last has at least two shaped members, a first shaped member and a second shaped member, which are rigid or semirigid, and which are mutually moved away by an extensible device.

21. The process according to claim 20, wherein the first shaped member corresponds to a portion of a foot which includes a heel, while the second shaped member corresponds to a portion of the foot which includes a tip.

22. The process according to claim 20, wherein a rod which protrudes out of the footwear is joined to the first shaped member or to the second shaped member.

23. The process according to claim 15, wherein an outer surface of the last is concave in correspondence with the seams joining the at least one lower portion and the at least one upper portion of the upper.

* * * * *

UNITED STATES PATENT AND TRADEMARK OFFICE

CERTIFICATE OF CORRECTION

PATENT NO. : 8,677,539 B2
APPLICATION NO. : 11/995493
DATED : March 25, 2014
INVENTOR(S) : Morlacchi et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 882 days.

Signed and Sealed this
Twenty-ninth Day of September, 2015

Michelle K. Lee

Michelle K. Lee
*Director of the United States Patent and Trademark Office*